US012180658B2

(12) United States Patent
Fuessel et al.

(10) Patent No.: US 12,180,658 B2
(45) **Date of Patent: *Dec. 31, 2024**

(54) RAIL THREADER WORKHEAD

(71) Applicant: S.W.N.G., Inc., Franklin Park, IL (US)

(72) Inventors: Jason M. Fuessel, Regina (CA); Justin J. Pipol, Hartland, WI (US)

(73) Assignee: S.W.N.G., Inc., Franklin Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/464,782

(22) Filed: Sep. 11, 2023

(65) Prior Publication Data

US 2023/0416995 A1 Dec. 28, 2023

Related U.S. Application Data

(63) Continuation of application No. 17/008,223, filed on Aug. 31, 2020, now Pat. No. 11,753,775.

(51) Int. Cl.
*E01B 29/32* (2006.01)
*E01B 33/08* (2006.01)

(52) U.S. Cl.
CPC ..... *E01B 29/32* (2013.01); *E01B 33/08* (2013.01)

(58) Field of Classification Search
CPC ..... E01B 29/04; E01B 29/16; E01B 29/17; E01B 29/22; E01B 29/32; E01B 31/02; E01B 31/08; E01B 33/08
See application file for complete search history.

(56) References Cited

U.S. PATENT DOCUMENTS

| | | | |
|---|---|---|---|
| 3,066,913 | A | 12/1962 | Leeson |
| 3,365,164 | A | 1/1968 | Engels |
| 3,405,649 | A | 10/1968 | Foxx et al. |
| 3,414,316 | A | 12/1968 | Williams et al. |
| 3,426,698 | A | 2/1969 | Foxx et al. |
| 3,465,687 | A | 9/1969 | Kerns |
| 3,552,320 | A | 1/1971 | Traupmann |
| 3,635,164 | A | 1/1972 | Patton |
| 4,131,067 | A | 12/1978 | Newman et al. |
| 4,155,507 | A | 5/1979 | Chierici et al. |
| 4,273,052 | A | 6/1981 | Woolner et al. |
| 4,493,202 | A | 1/1985 | Stafford |

(Continued)

OTHER PUBLICATIONS

Youtube, 2nd Tie Spiker —14th Machine in CP Rail work gang, published Mar. 26, 2014 Link: https://www.youtube.com/watch?v=y-KqWCwyVeU.

(Continued)

*Primary Examiner* — Robert J McCarry, Jr.
(74) *Attorney, Agent, or Firm* — Neal, Gerber & Eisenberg LLP

(57) ABSTRACT

A rail threader workhead is disclosed for attachment to an end of a rail machine boom and configured for placing a railroad rail upon a section of railroad ties. The rail threader workhead includes a first apparatus for mounting to the end of the rail machine boom and operable to pivot in a vertical pitch direction, a second apparatus extending from the first apparatus and operable to pivot in a horizontal yaw direction, and a third apparatus extending from the second apparatus. The third apparatus includes a pair of roller assemblies configured to engage the railroad rail, the third apparatus configured to pivot in a cant or roll direction.

20 Claims, 17 Drawing Sheets

(56) References Cited

U.S. PATENT DOCUMENTS

| | | | | |
|---|---|---|---|---|
| 4,538,793 | A | 9/1985 | Dieringer et al. | |
| 4,579,061 | A | 4/1986 | Dieringer | |
| 4,874,518 | A | 10/1989 | Kirkland et al. | |
| 5,191,840 | A | 3/1993 | Cotic et al. | |
| 5,253,844 | A | 10/1993 | Cotic et al. | |
| 5,487,341 | A | 1/1996 | Newman et al. | |
| 5,542,355 | A | 8/1996 | Madison et al. | |
| 6,095,053 | A | 8/2000 | Johnsen et al. | |
| 6,113,073 | A | 9/2000 | Lefavour et al. | |
| 6,974,087 | B2 | 12/2005 | Faichney | |
| 7,216,590 | B2 | 5/2007 | Eldridge et al. | |
| 7,353,757 | B2 | 4/2008 | Eldridge | |
| 8,485,103 | B2 | 7/2013 | Miller et al. | |
| 8,516,695 | B2 | 8/2013 | Zhao et al. | |
| 8,516,965 | B2 | 8/2013 | Pier et al. | |
| 8,857,344 | B2 | 10/2014 | Pier et al. | |
| 9,771,690 | B2 | 9/2017 | Henke | |
| 10,190,264 | B2 | 1/2019 | Hamilton et al. | |
| 10,927,509 | B2 | 2/2021 | Pipol et al. | |
| 11,220,791 | B2 | 1/2022 | Henke et al. | |
| 11,753,775 | B2 * | 9/2023 | Fuessel ..... | E01B 29/32 104/2 |
| 2005/0081735 | A1 | 4/2005 | Hosking et al. | |
| 2006/0096399 | A1 | 5/2006 | Harper et al. | |
| 2009/0095188 | A1 | 4/2009 | Bounds | |
| 2018/0223482 | A1 | 8/2018 | Hamilton et al. | |
| 2018/0355559 | A1 | 12/2018 | Pipol et al. | |
| 2019/0010665 | A1 | 1/2019 | Vargas et al. | |
| 2020/0325635 | A1 | 10/2020 | Henke et al. | |
| 2020/0325636 | A1 | 10/2020 | Pipol et al. | |
| 2022/0064870 | A1 | 3/2022 | Fuessel et al. | |
| 2022/0127795 | A1 | 4/2022 | Henke et al. | |

OTHER PUBLICATIONS

Nordco, "Spike Puller Two Rail," [retrieved from the internet on Mar. 30, 2018 from URL:https://www.nordco.com/products-catalog/maintenance-of-way/Spike-Pulling-Machines/Spike-Puller-Two-Rail---SP2R.htm].

Swingmaster, "SSPW Swingmaster Spike Puller Workhead," [retrieved from the internet on Jun. 18, 2019 from URL: http://www.swingmastercorp.com/wp-content/uploads/2018/09/SSPW-Brochure.pdf] (1 page).

The United States Patent and Trademark Office, International Search Report and Written Opinion in International Application No. PCT/US19/58091 (Jan. 9, 2020) (5 pages).

The United States Patent and Trademark Office, International Search Report and Written Opinion in International Application No. PCT/US19/29934 (Jul. 19, 2019) (17 pages).

The United States Patent and Trademark Office, International Search Report and Written Opinion in International Application No. PCT/US20/48811 (Nov. 24, 2020) (13 pages).

* cited by examiner

RAIL THREADER WORKHEAD

CROSS REFERENCE TO RELATED APPLICATIONS

This application is a continuation of U.S. application Ser. No. 17/008,223, filed Aug. 31, 2020, which is incorporated by reference herein in its entirety.

BACKGROUND

This disclosure relates to the field of machines for maintaining railroads, and in particular, to machines that install railroad rails along a railway.

Railroad rails are difficult to install along a railway to form a track. In the past, rail lifting machines or cranes were configured to hoist a large section of rail into the air by lifting the rail with chains at a lift point along the rail. To lift the rail, an articulating claw suspended from the end of a chain hanging from the end of the boom of the crane would be positioned to engage the rail under the inside and outside surfaces of the head of the rail at the desired lift point. Once the claw was positioned along the rail, the crane operator would lift the section of track and position the section as close to the desired location as possible across the railroad ties. However, the process of placing a rail into place by the crane was inconsistent, imprecise, time consuming, and did not allow for easy insertion of the rail under a lug of the tie plate. In addition, previously known rail lifting machines or cranes were configured with a single operator station, which inhibits the operator's ability to see and control placement of both an inside rail and an outside rail across a set of railroad ties.

Consequently, there exists a need for an apparatus that solves these and other problems.

SUMMARY

An embodiment of a rail threader workhead for attachment to an end of a rail machine boom and configured for placing a railroad rail upon a section of railroad ties is disclosed, comprising: (i) a first apparatus for mounting to the end of the rail machine boom and operable to pivot in a vertical pitch direction; (ii) a second apparatus extending from the first apparatus and operable to pivot in a horizontal yaw direction; and a third apparatus extending from the second apparatus, the third apparatus comprising a pair of roller assemblies configured to engage the railroad rail, the third apparatus configured to pivot in a cant or roll direction.

The first, second, and third apparatus may be configured to operate independently of one another. The first, second, and third apparatus may be configured to operate simultaneously with one another. The first, second, and third apparatus may be configured to operate in series with one another.

The first apparatus may include a pair of horizontally oriented first hydraulic cylinders for pivoting the second apparatus in the yaw direction. Each of the first hydraulic cylinders may be configured to pivot about a vertical axis that intersects a longitudinal axis of each of the first hydraulic cylinders. The second apparatus may include a pair of vertically oriented second hydraulic cylinders for pivoting the third apparatus in the cant or roll direction. Each of the second hydraulic cylinders may be configured to pivot about a horizontal axis that intersects a longitudinal axis of each of the second hydraulic cylinders. The third apparatus may include a pair of third hydraulic cylinders to actuate the pair of roller assemblies to engage the railroad rail. The rail threader workhead may include a pair of roller arms that are pivotably attached to a cant or roll apparatus of the third apparatus. An upper end of each of the third hydraulic cylinders may be connected to the cant or roll apparatus, and a lower end of each of the third hydraulic cylinders may be connected to a respective roller arm. Each of the roller arms may be connected to a respective roller assembly. Each of the roller assemblies may include a pair of roller bearings configured to rotate on an internal, stationary shaft that is mounted to each of the roller arms.

The first apparatus may pivot about a first horizontal pin that is perpendicular to a longitudinal axis of the rail machine boom, the second apparatus may pivot about a vertical pin, and the third apparatus may pivot about a second horizontal pin that is perpendicular to the first horizontal pin.

Another embodiment of a rail threader workhead for attachment to an end of a rail machine boom and configured for placing a railroad rail upon a section of railroad ties is disclosed, comprising: (i) a first apparatus for mounting to the end of the rail machine boom, the first apparatus configured to pivot in a vertical pitch direction about a first horizontal pin that is perpendicular to a longitudinal axis of the rail machine boom; (ii) a second apparatus extending from the first apparatus, the second apparatus configured to pivot about a vertical pin in a horizontal yaw direction; and (iii) a third apparatus extending from the second apparatus, the third apparatus configured to pivot in a cant or roll direction about a second horizontal pin that is perpendicular to the first horizontal pin.

The first horizontal pin may be attached to and extend from a first receiver connected to a first side panel of the first apparatus to a second receiver connected to a second side panel of the first apparatus. The vertical pin may be attached to and extend from a top receiver connected to a top panel of the first apparatus to a bottom receiver connected to a bottom panel of the first apparatus. The second horizontal pin is attached to and extends from a front receiver connected to a front panel of the second apparatus to a rear receiver connected to a rear panel of the second apparatus.

The rail threader workhead may include a pair of roller assemblies attached to the third apparatus for engaging the railroad rail. The pair of roller assemblies may be configured to permit movement of the railroad rail in the cant or roll direction when the third apparatus pivots in the cant or roll direction.

The first apparatus may include a pair of horizontally oriented first hydraulic cylinders for pivoting the second apparatus in the yaw direction. The second apparatus may include a pair of vertically oriented second hydraulic cylinders for pivoting the third apparatus in the cant or roll direction. The third apparatus may include a pair of third hydraulic cylinders to actuate a pair of roller assemblies to engage the railroad rail. The pair of roller assemblies may be configured to permit movement of the railroad rail in the cant or roll direction when the third apparatus pivots in the cant or roll direction. The rail threader workhead may include a pair of roller arms that are pivotably attached to a cant or roll apparatus of the third apparatus. An upper end of each of the third hydraulic cylinders may be connected to the cant or roll apparatus, and a lower end of each of the third hydraulic cylinders may be connected to a respective roller arm.

BRIEF DESCRIPTION OF THE DRAWINGS

For a better understanding of the features described in this disclosure, reference may be made to embodiments shown in the drawings. The components in the drawings are not necessarily to scale, and related elements may be omitted so as to emphasize and clearly illustrate the novel features described herein. In addition, system components can be variously arranged, as known in the art. In the figures, like referenced numerals may refer to like parts throughout the different figures unless otherwise specified.

DETAILED DESCRIPTION

Figure 1:
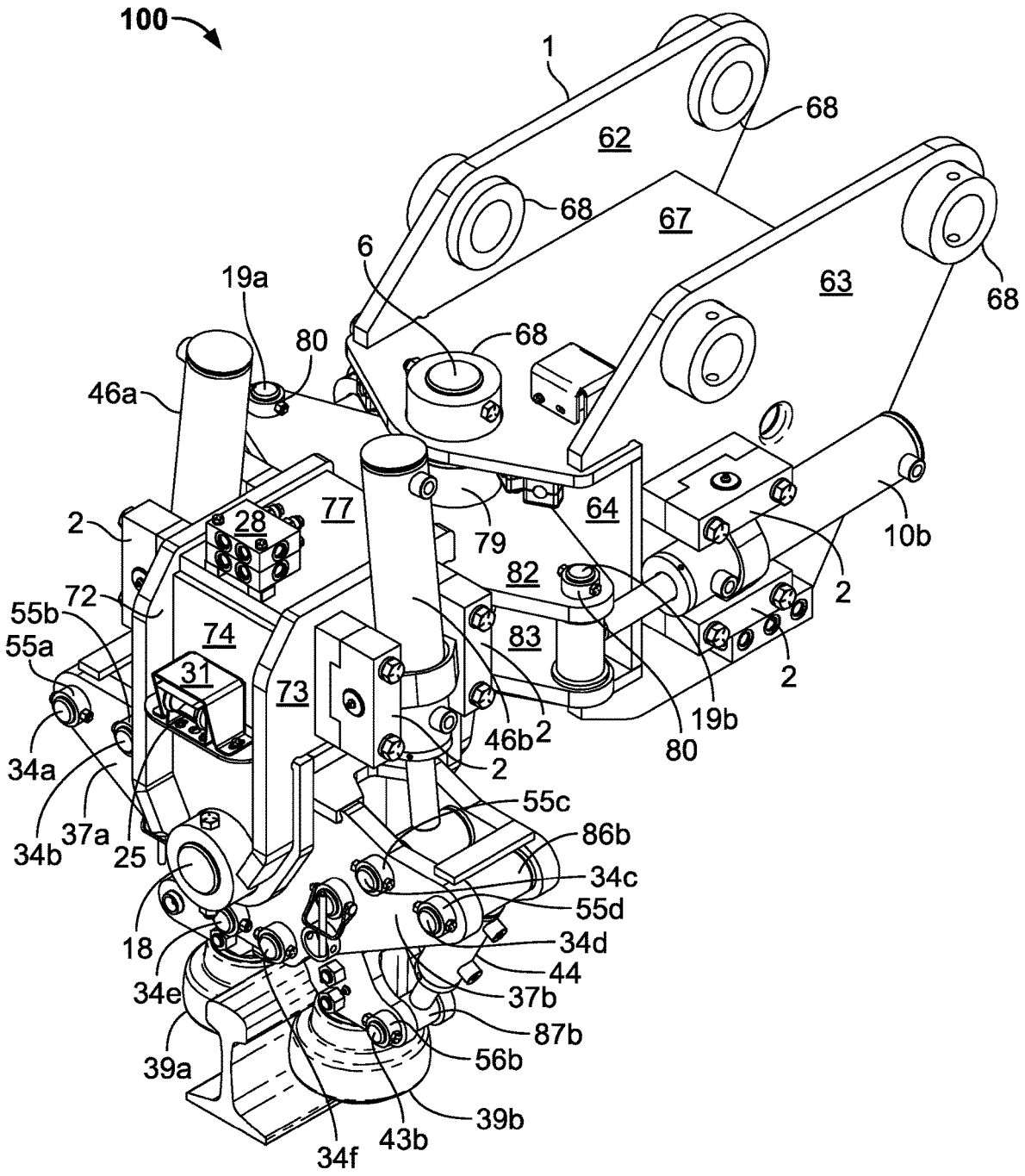
FIG. 1 is a right, front, top, perspective view of an embodiment of a railroad rail threader apparatus of the instant disclosure shown in a first articulated position.
Figure 2:
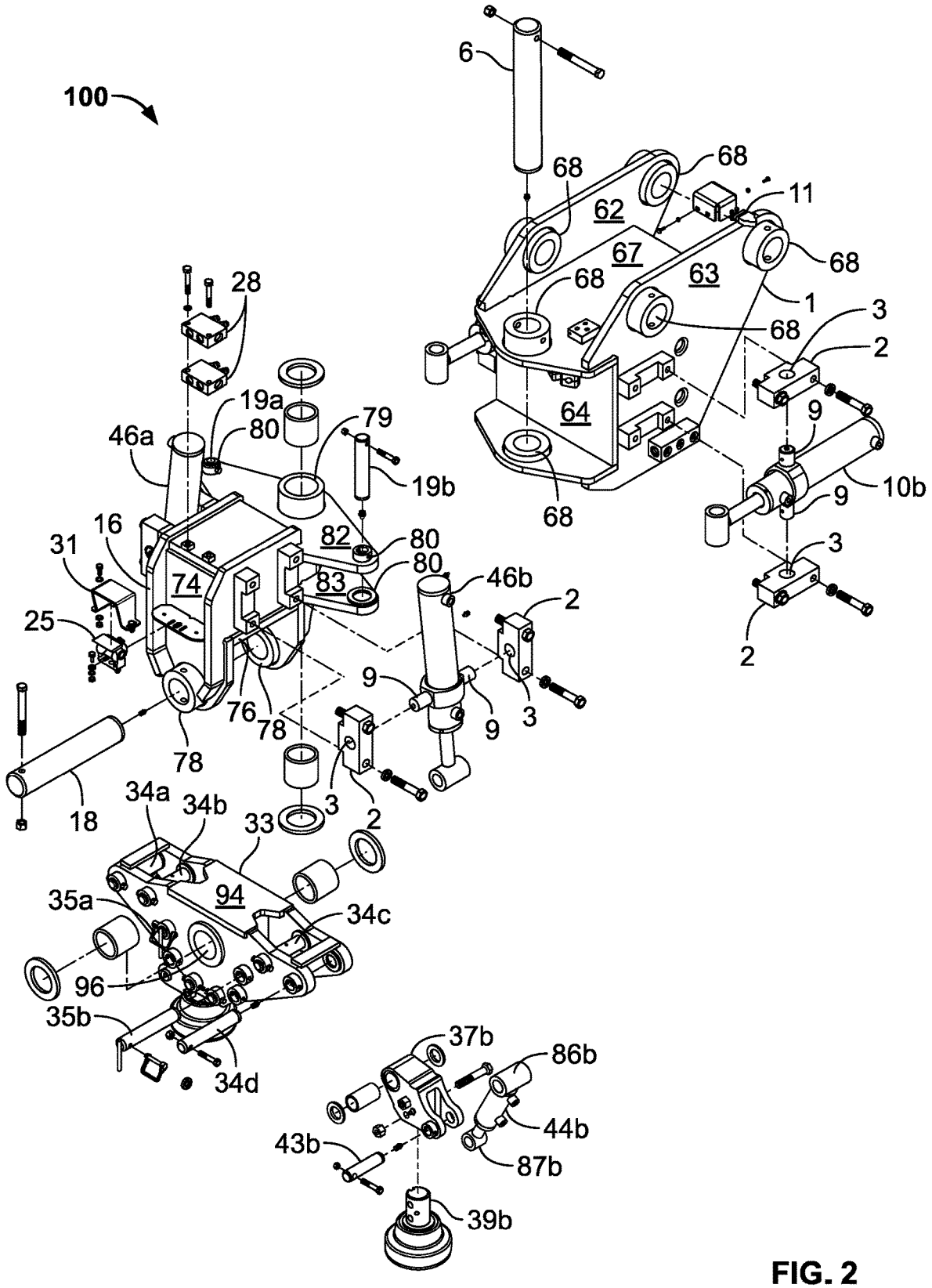
FIG. 2 is a first partial detail exploded perspective view of the embodiment shown in FIG. 1.

While the features, methods, devices, and systems described herein may be embodied in various forms, there are shown in the drawings, and will hereinafter be described, some exemplary and non-limiting embodiments. Not all of the depicted components described in this disclosure may be required, however, and some implementations may include additional, different, or fewer components from those expressly described in this disclosure. Variations in the arrangement and type of the components may be made without departing from the spirit or scope of the claims as set forth herein. Thus, it should be appreciated that any of the features of an embodiment discussed with reference to the figures herein may be combined with or substituted for features discussed in connection with other embodiments in this disclosure.

The instant disclosure describes and illustrates various embodiments of a rail threader workhead apparatus for grabbing, hoisting, and inserting railroad rails onto railroad ties and vice versa. In at least some embodiments, the workhead apparatus includes a first apparatus for mounting to a rail machine boom and operable to articulate the workhead apparatus in a vertical, pitch direction; a second apparatus connected to the first apparatus and operable to move the second apparatus in a yaw direction; and a third apparatus connected to the second apparatus and operable to grab a rail section and to articulate the third apparatus in a rotational direction when viewed in elevation from the front of the workhead. The first, second, and third apparatus may be configured to articulate individually, all three simultaneously, or in simultaneous pairs. In some embodiments, manual or automated movement of the first, second, and third apparatus may be performed in a sequence or simultaneously. For example, movement of the third apparatus in a roll direction may be performed in a sequence with or simultaneously with move of the first apparatus in a pitch direction. As will be described in more detail below, articulating the first, second, and third apparatus in the pitch, yaw, and roll directions allows easy movement of the rail section while taking advantage of natural longitudinal rail bending to aid the process—all while maximizing an operator's sight down the rail when sitting in the operator station of the rail machine.

The rail machine may be configured with one or more operator stations, such as a pair of operator stations. The one or more operator stations may be configured to be operated by a single operator. For example, if the rail machine is configured with a pair of operator stations, an operator positioned longitudinally along a desired inside rail or a desired outside rail location may easily see along the path for the desired rail location. The rail machine may be configured to traverse on the railroad track to the point in the track where a new rail is desired to be placed ahead of the rail machine. The rail machine may include a crane boom and the rail threader workhead as shown and described herein for grabbing and hoisting sections of rail from a location adjacent to the track and for positioning the rail section in a desired location across the railroad ties, or to remove sections of rail from an installed location to a position adjacent to the track.

The rail machine and the rail threader workhead may be operated hydraulically, pneumatically, electromechanically, or a combination of all three. In the embodiments shown in the figures, the boom, the first apparatus, the second apparatus, and the third apparatus described above and described in detail herein are configured for hydraulic operation, all of which being operable from a human operator positioned on the rail machine. In other embodiments, a human operator via a remote interface and/or display may remotely connect to a wireless transceiver on the rail machine to drive and/or operate one or more of the boom, the first apparatus, the second apparatus, and the third apparatus, all of which being connected electronically to one another on a local network, such as a CAN-Bus network, and driven by electromechanical actuators and/or hydraulic mechanisms. In such embodiments, the transceiver may include a processor and memory and one or more input/output buses for communicating electronic commands from the processor to rail machine components, including one or more components associated with the rail threader workhead, as well as feedback signals from one or more position sensors associated with such components. Likewise, the remote interface and/or display, such as a touchscreen display on which is displayed a user interface, may include a processor, memory, and an wireless transceiver for transmitting and receiving signals to and from the transceiver on the rail machine. In various embodiments, the remote transceiver is a mobile phone, a mobile computer, a remote internet connected computer, and the like. Wireless signals may be communicated to and from the respective transceivers via WiFi, cellular, satellite, near-field communications, Bluetooth, or any other suitable wireless means. In this way, a human operator may be stationed alongside a portion of the track and command the rail machine from his/her remote vantage point to grab, hoist, and position a section of rail on a desired installation location, or conversely, to remove a section of installed rail and to place it alongside the track. The rail machine may include one or more cameras positioned strategically on the rail machine, boom, and/or rail threader workhead and/or on one or more camera stands or tripods positioned alongside the track for aiding a remote operator to operate the rail machine and/or the rail threader workhead. The one or more cameras may wirelessly stream images or video to either the operator's display or user interface onboard the rail machine or to the remote operator for display or both to one or more user interfaces and/or displays to aid the operator in moving sections of rail.

A central processing unit comprising a processor and memory may be positioned onboard the rail threader workhead to (i) receive and process sensor data and operator input commands (including input commands received by the onboard transceiver from the remote transceiver), (ii) output command signals to one or more components of the rail threader workhead to cause motion, for example, of a commanded component commensurate with input signals, and/or (iii) output data signals to the operator's display or user interface onboard the rail machine. In some embodiments, such data signals may also be simultaneously transmitted to a remote operator's display or user interface via the respective transceivers discussed above. In other embodiments, such data signals may be transmitted to the remote operator's display or user interface instead of to an onboard operator's display or user interface.

The central processing unit may also be connected to the local network described above. For example, one or more sensors, such as one or more position or angle sensors, may be strategically positioned on various components of the rail threader workhead to post component position or angle data on the local network. The processor of the central processing unit may receive such data as well as any input data from the operator, determine appropriate output signals to operate one or more components of the rail threader workhead in response to the position or angle feedback data and operator input data, and post the output command(s) on the local network to enable the component to effect the desired command.

Turning now to the figures, there is shown various aspects of rail threader workhead 100 for mounting to boom 150 of rail machine 200. As shown in FIGS. 1-7, Rail threader workhead 100 includes: (i) manipulator head 1 configured for rotation about a horizontally oriented pin 50 in a pitch direction in a first vertical plane aligned longitudinally with boom 150, (ii) manipulator box 16 configured for rotation about a vertically oriented pin 6 in a yaw direction in a horizontal plane, and (iii) manipulator head 33 configured for rotation about a horizontally oriented pin 18 in a cant or roll direction in a second vertical plane. Manipulator head 33 includes a pair of opposed rail manipulator roller arms 37 configured to rotate about respective horizontally oriented pins 34*e*, 34*f* to enable respective roller assemblies 39 connected to the respective roller arms 37 to rotate in a roll direction in a third vertical plane that is aligned with the second vertical plane.

In the embodiments shown in the figures, hydraulic cylinders of varying diameters and lengths are strategically positioned on boom 150 and/or rail threader workhead 100 to enable the rotational motion of manipulator head 1, manipulator box 16, manipulator head 33, and rail manipulator roller arms 37.

Figure 3:
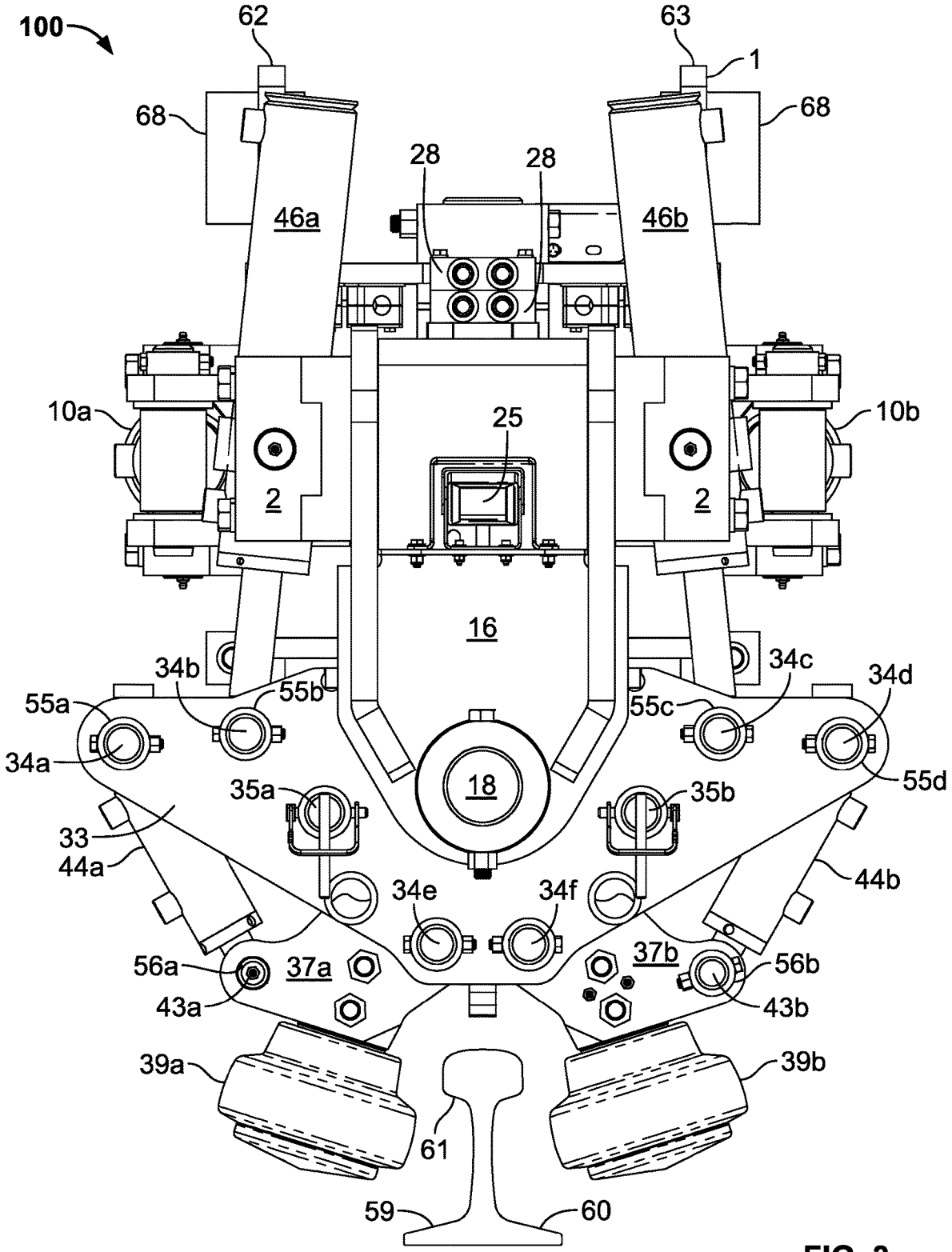
FIG. 3 is a front elevation view of the embodiment of FIG. 1 shown in a first position before engaging a rail.
Figure 4:
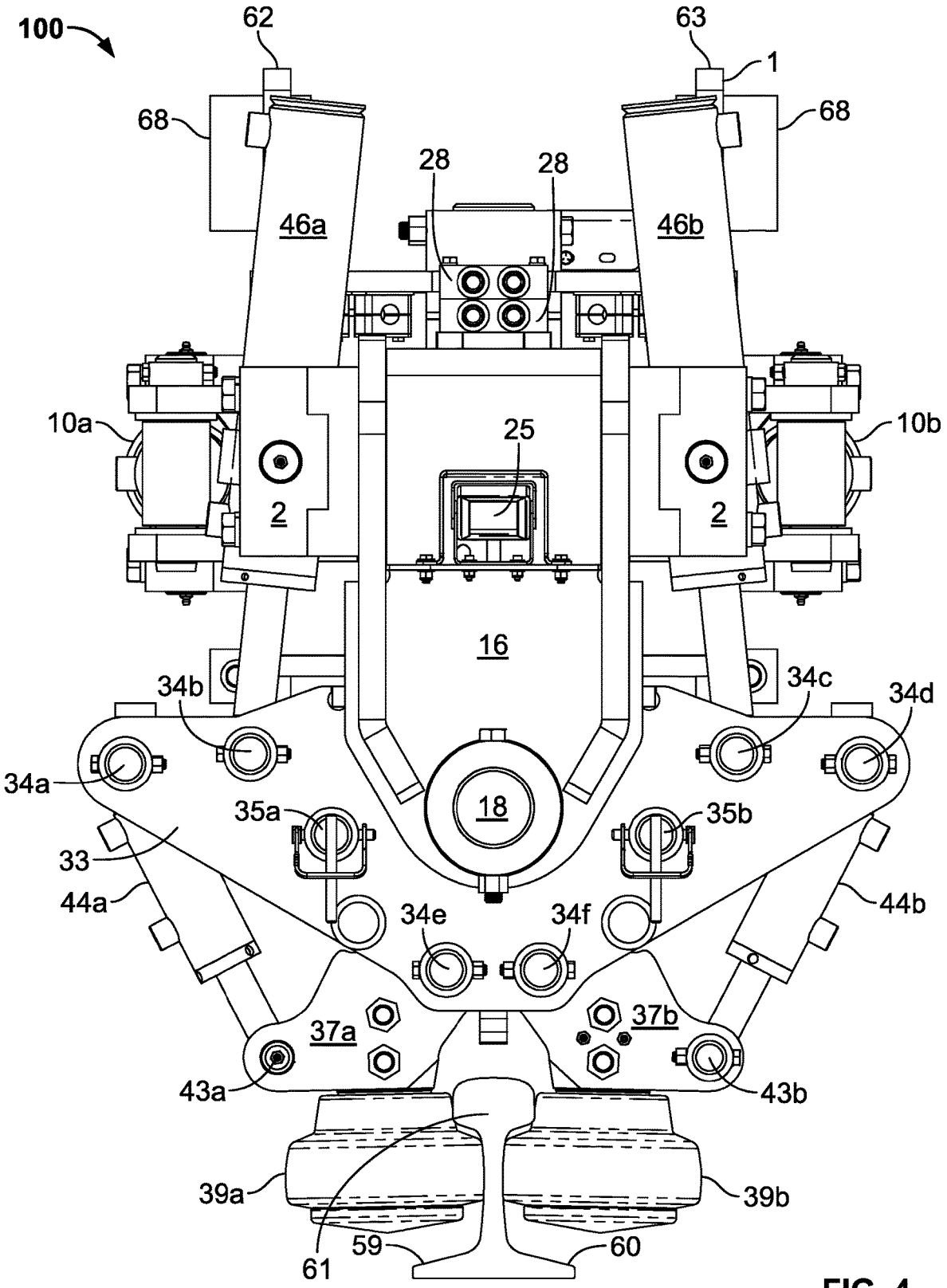
FIG. 4 is a front elevation view of the embodiment of FIG. 1 shown in a second position after engaging a rail.
Figure 5:
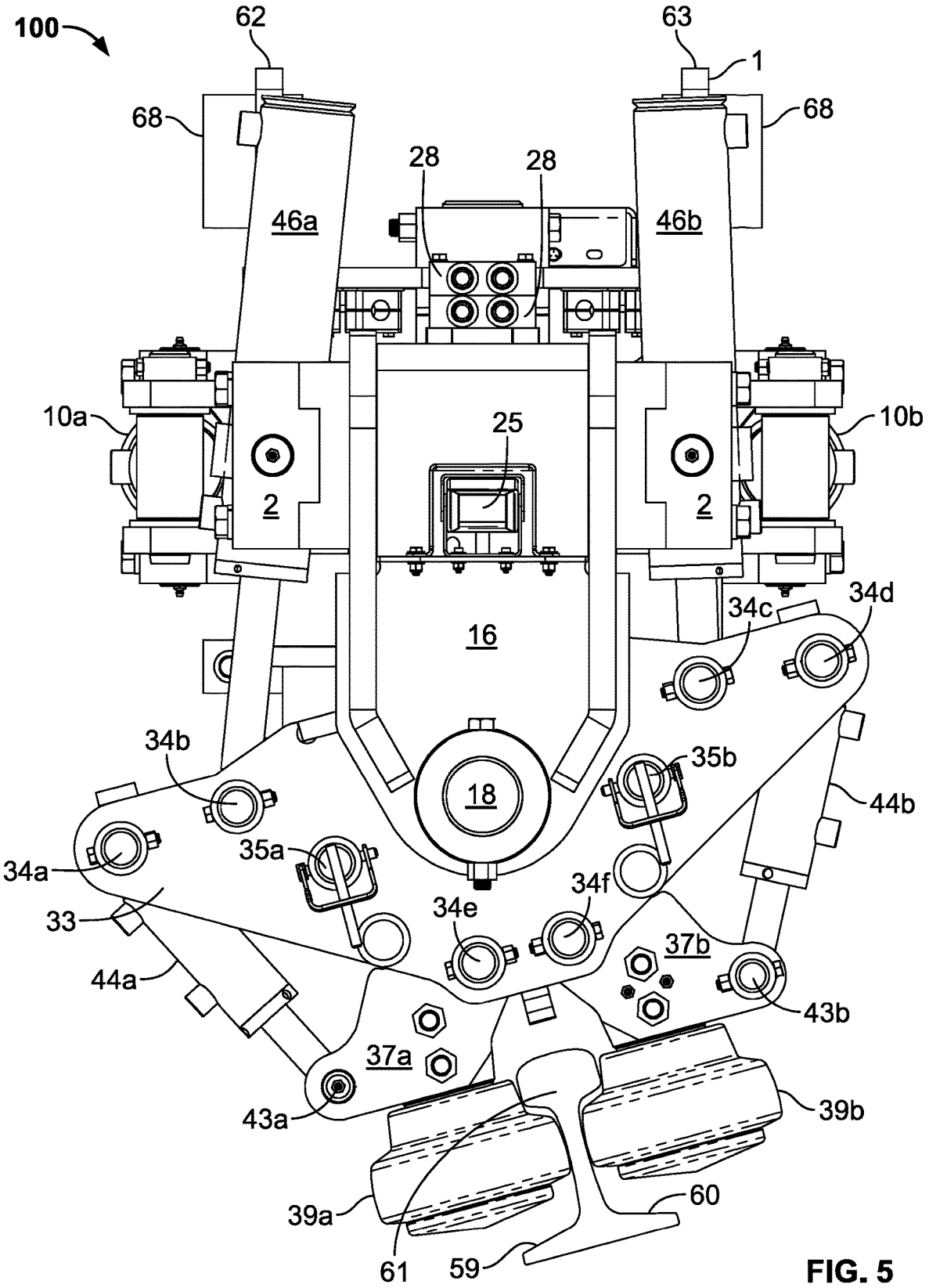
FIG. 5 is a front elevation view of the embodiment of FIG. 1 shown in a third position after canting a rail in a cant or roll direction.

For example, as shown in FIGS. 3-5, rail squeeze cylinders 44*a*, 44*b* positioned on opposite sides of manipulator head 33 are independently actuated but nevertheless configured to work in tandem to cause roller assemblies 39*a*, 39*b* to engage both sides of the head of rail Each roller assembly 39*a*, 39*b* includes a pair of roller bearings configured to rotate on an internal shaft that is mounted to respective rail manipulator roller arms 37*a*, 37*b*. This configuration allows at least some longitudinal motion of rail 60 between roller assemblies 39*a*, 39*b* and vice versa to avoid galling, scratching, and gouging of rail 60 during handling of rail FIG. 3 shows rail squeeze cylinders 44*a*, 44*b* in retracted positions to cause roller assemblies 39*a*, 39*b* to be in an ungrasped position relative to rail 60. FIGS. 4-5 show rail squeeze cylinders 44*a*, 44*b* in extended positions to cause roller assemblies 39*a*, 39*b* to grasp rail 60. Counterbalance valves 28 are configured to hydraulically lock the rail squeeze cylinders 44*a*, 44*b* in the extended position to prevent the roller assemblies 39*a*, 39*b* from inadvertently retracting and opening to avoid "dropping" the rail.

Figure 14:
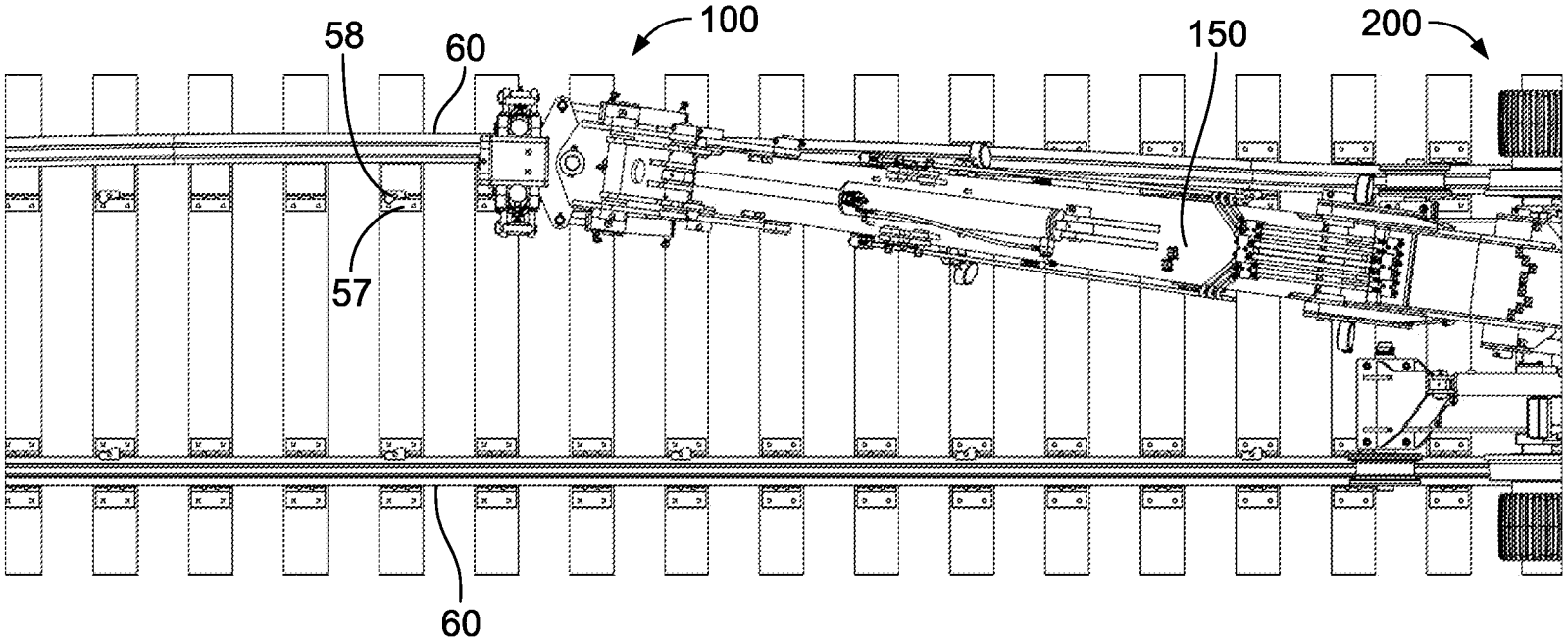
FIG. 14 is a top plan view of the embodiment of FIG. 1 shown positioned on an end of a boom in a third yaw position of the manipulator box while engaged with an opposite, canted rail as in FIG. 13.
Figure 15:
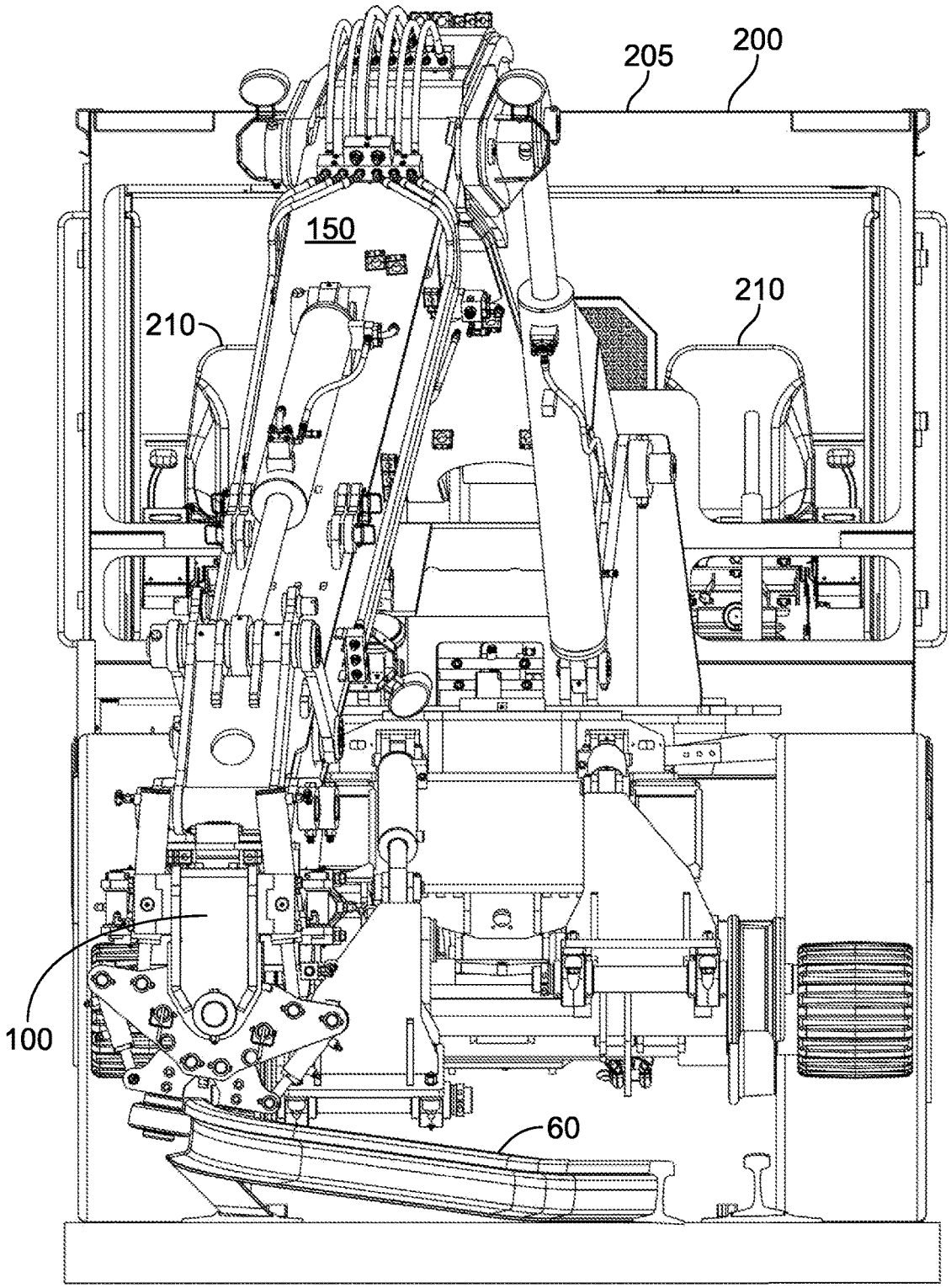
FIG. 15 is a front elevation view of the embodiment of FIG. 14.
Figure 16:
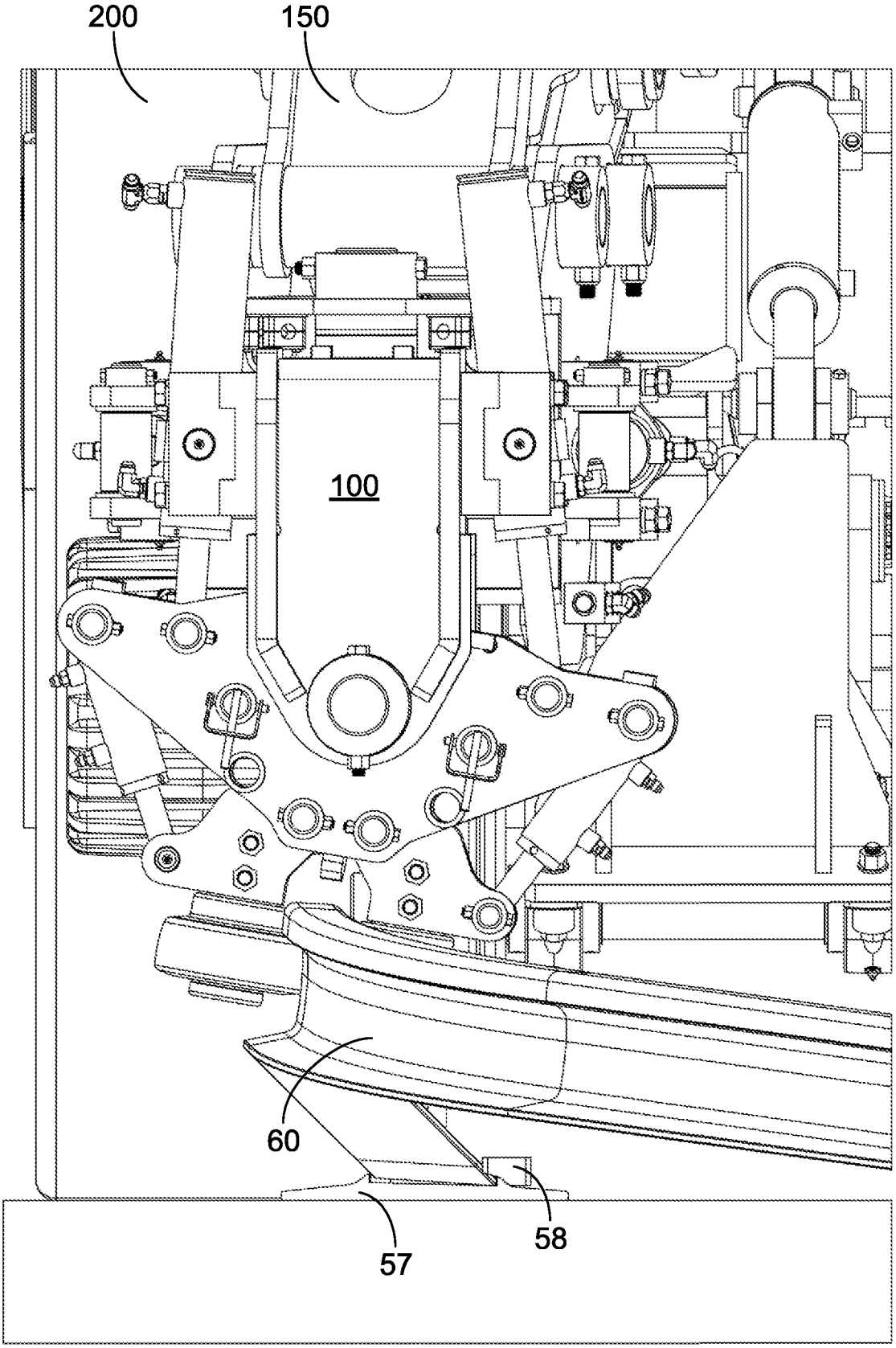
FIG. 16 is a front detail elevation view of the embodiment of FIG. 15.
Figure 17:
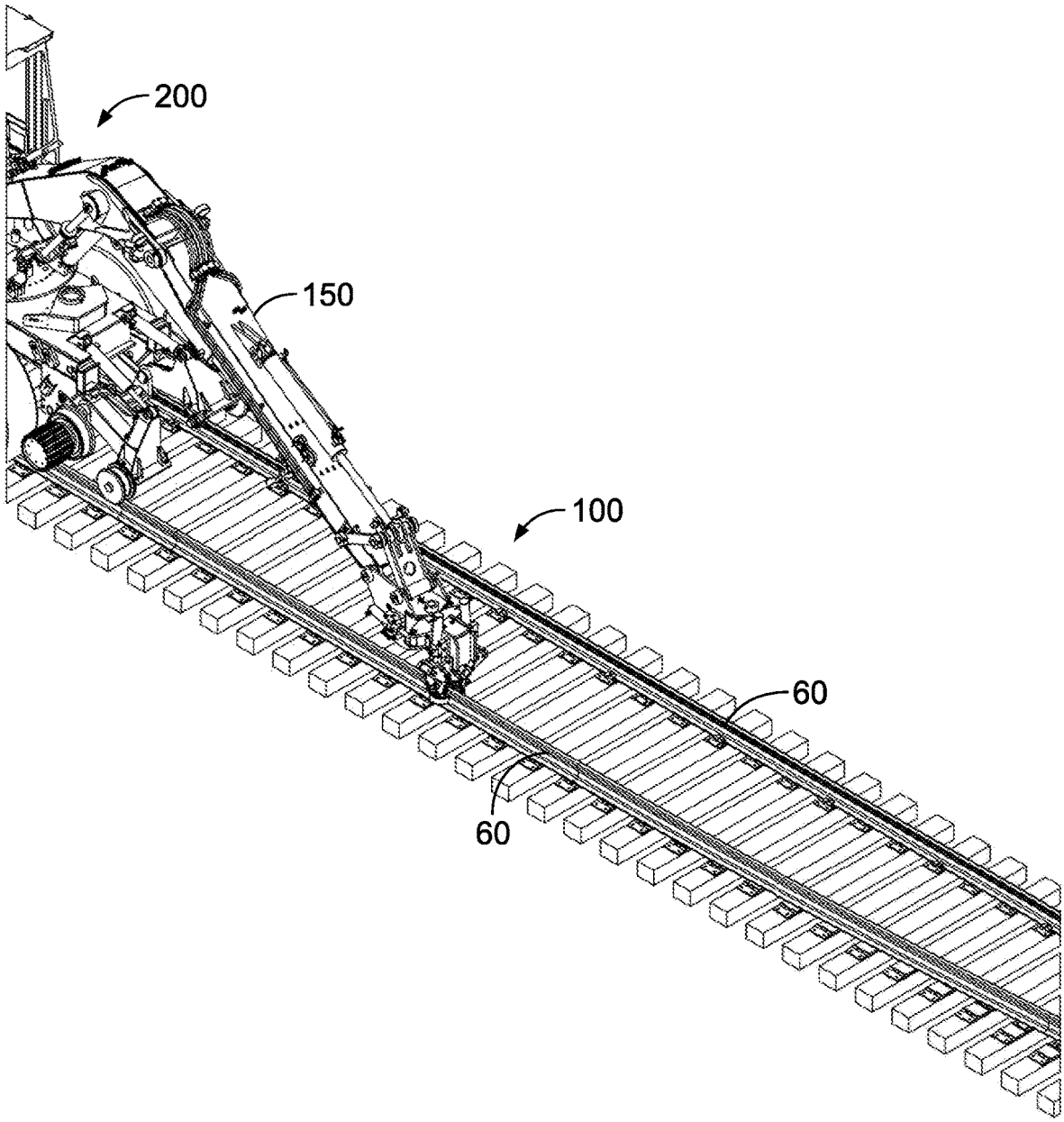
FIG. 17 is a left, front perspective view of the embodiment of FIG. 14.

Similarly, as shown in FIGS. 3-5, cant or roll cylinders 46*a*, 46*b* positioned on opposite sides of manipulator box 16 are configured to work in tandem to pivot manipulator head 33 in the roll direction (interchangeably called the "cant direction") via pin 18. FIG. 3 shows manipulator head 33 in a neutral position, longitudinally inline with manipulator box 16 and manipulator head 1. By extending and retracting respective cant or roll cylinders 46*a*, 46*b*, manipulator head 33 may be moved to a right rolled (aka right cant) position (as shown in FIG. 5) or a left rolled (aka left cant) position (as shown in FIGS. 14-17). In addition, when manipulator head 33 is moved to either a right rolled position or a left rolled position, a grasped rail 60 at a longitudinal grasp point of the rail is also moved accordingly, as shown in FIGS. 5, 15-16).

Figure 6:
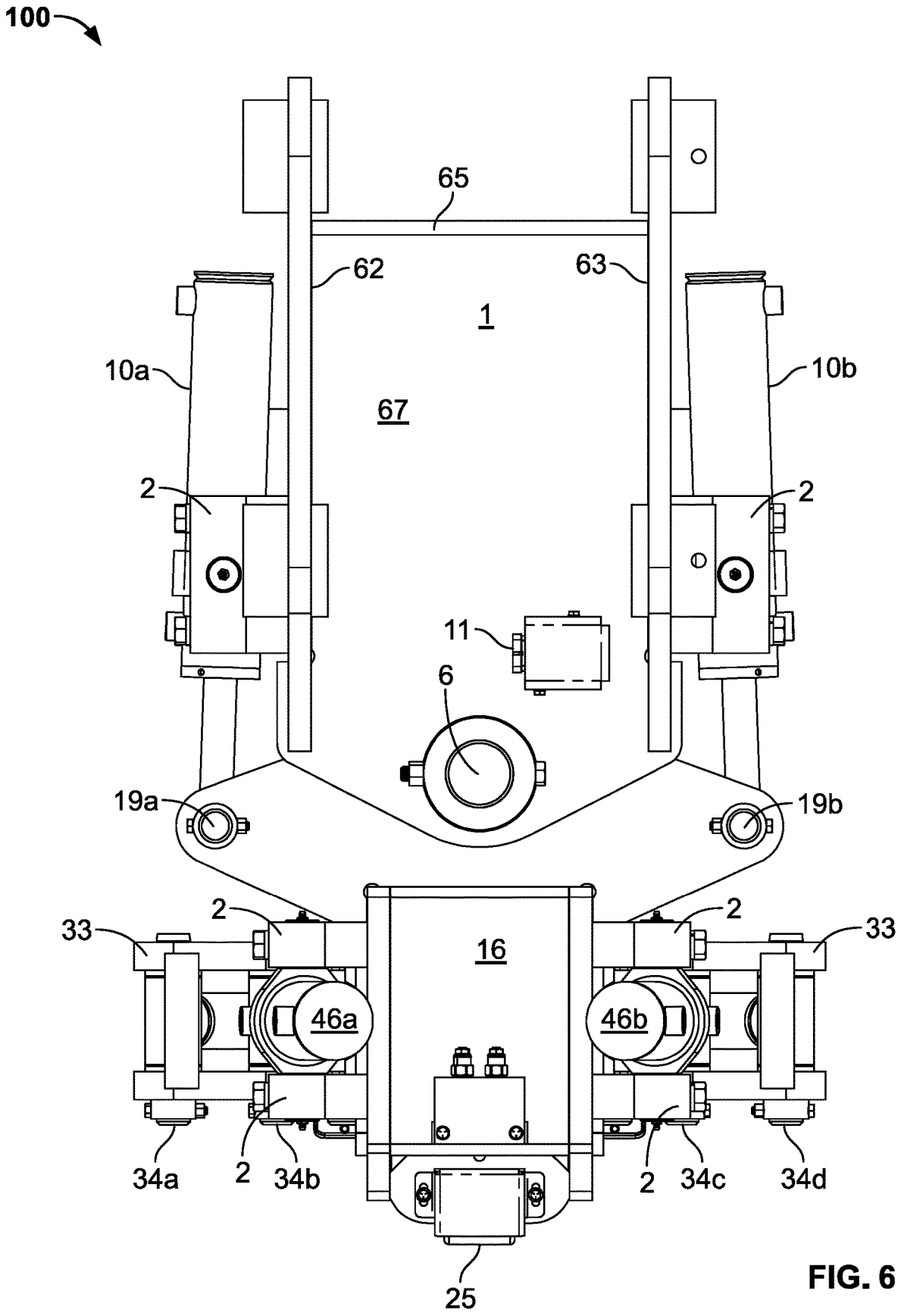
FIG. 6 is a top plan view of the embodiment of FIG. 1 shown in a first yaw position of the manipulator box.
Figure 7:
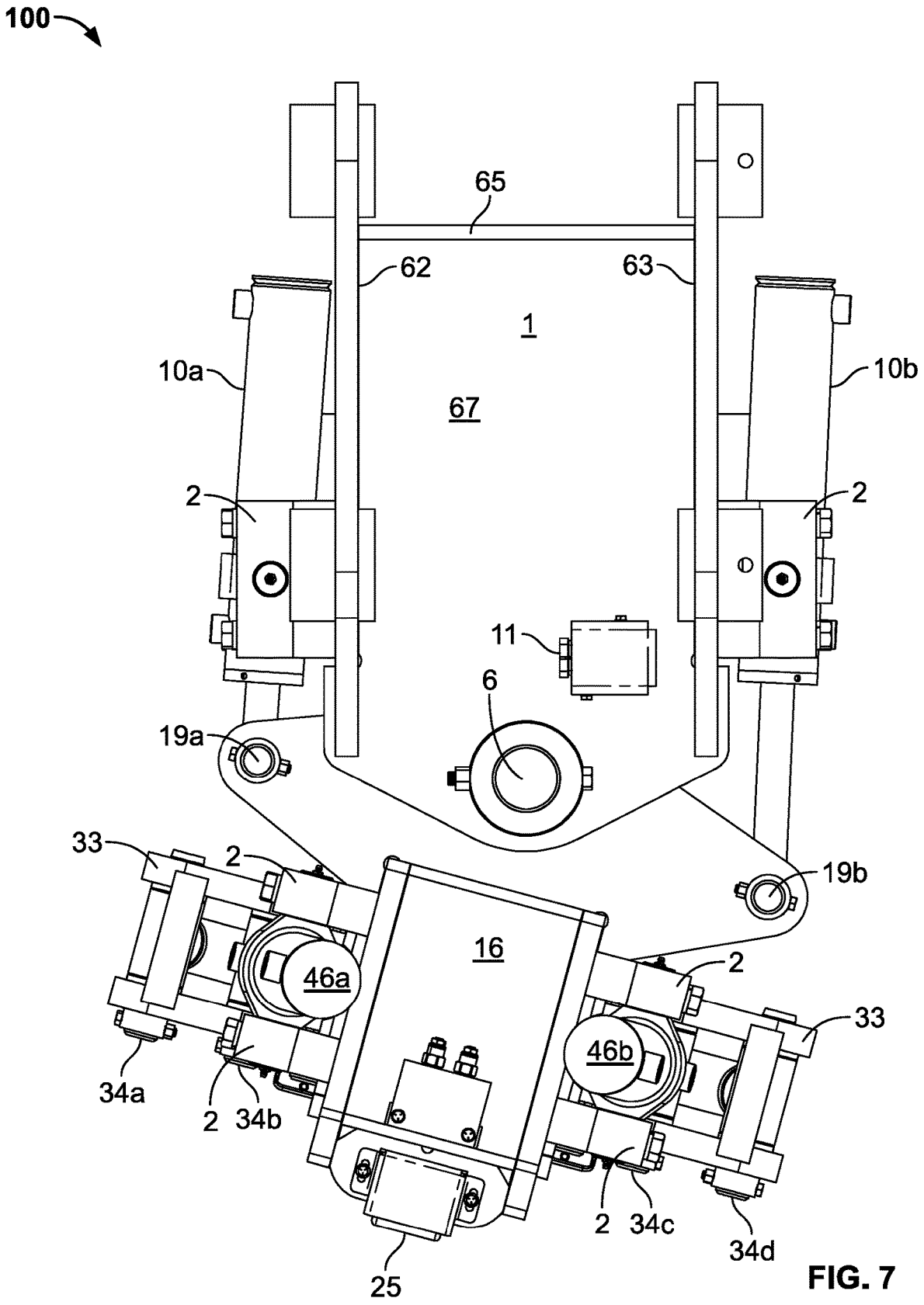
FIG. 7 is a top plan view of the embodiment of FIG. 1 shown in a second yaw position of the manipulator box.

As shown in FIGS. 6 and 7, yaw cylinders 10*a*, 10*b* positioned on opposite sides of manipulator head 1 are configured to work in tandem to pivot manipulator box 16 in the yaw direction via pin 6. FIG. 6 shows manipulator box 16 in a neutral position, longitudinally inline with manipulator head 1. By extending and retracting respective yaw cylinders 10*a*, 10*b*, manipulator box 16 may be moved to a left yaw position (as shown in FIG. 7) or a right yaw position (as shown in FIG. 14). This side to side motion allows boom 150 to be centrally mounted on rail machine 200 between the inside rail and the outside rail (see, e.g., FIG. 15) while allowing rail threader workhead 100 to insert/place both the inside rail and the outside rail across a set of railroad ties to form a section of railroad track.

Figure 8:
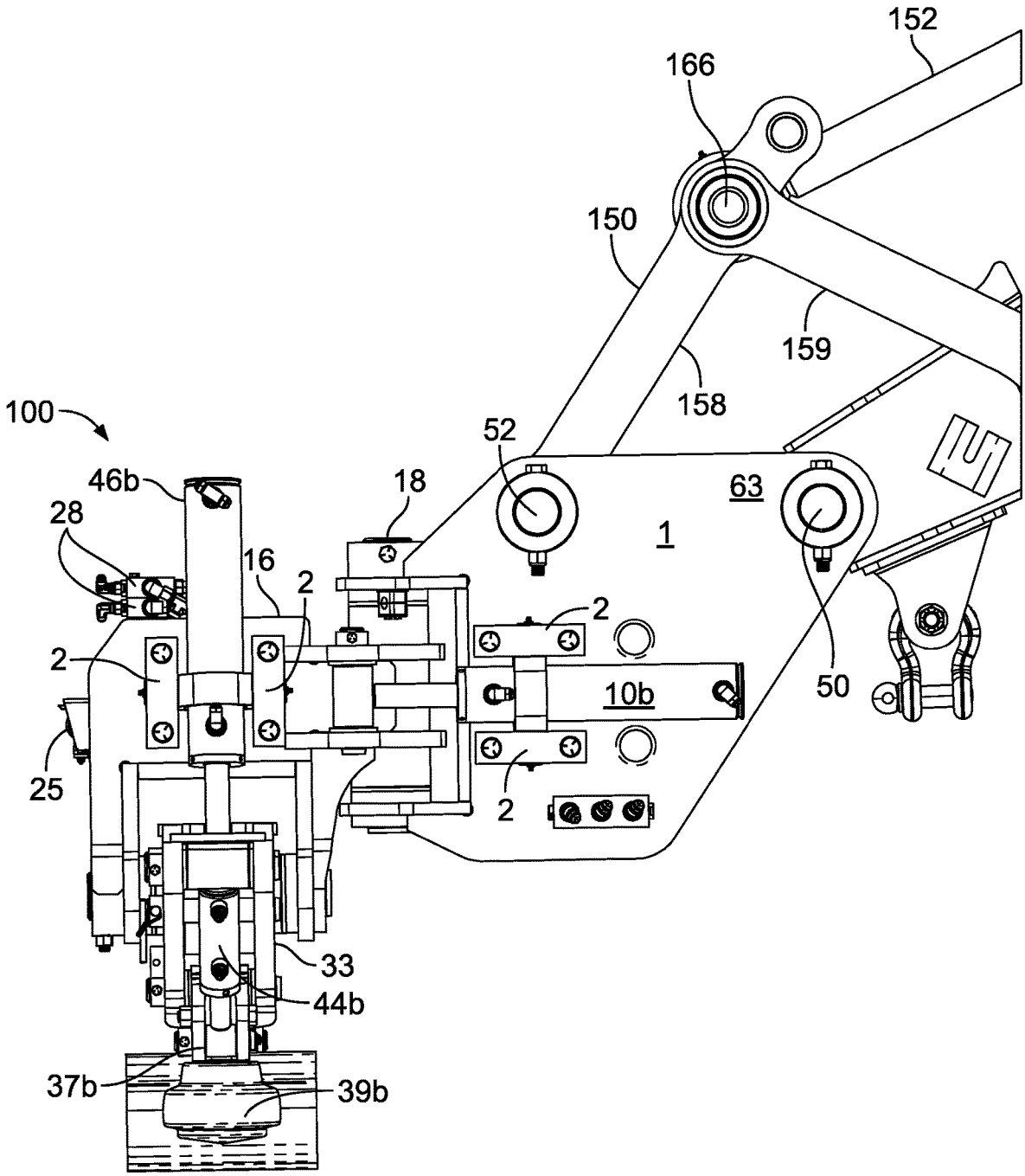
FIG. 8 is a right side elevation view of the embodiment of FIG. 1 shown positioned on an end of a boom and in a first pitch position.
Figure 9:
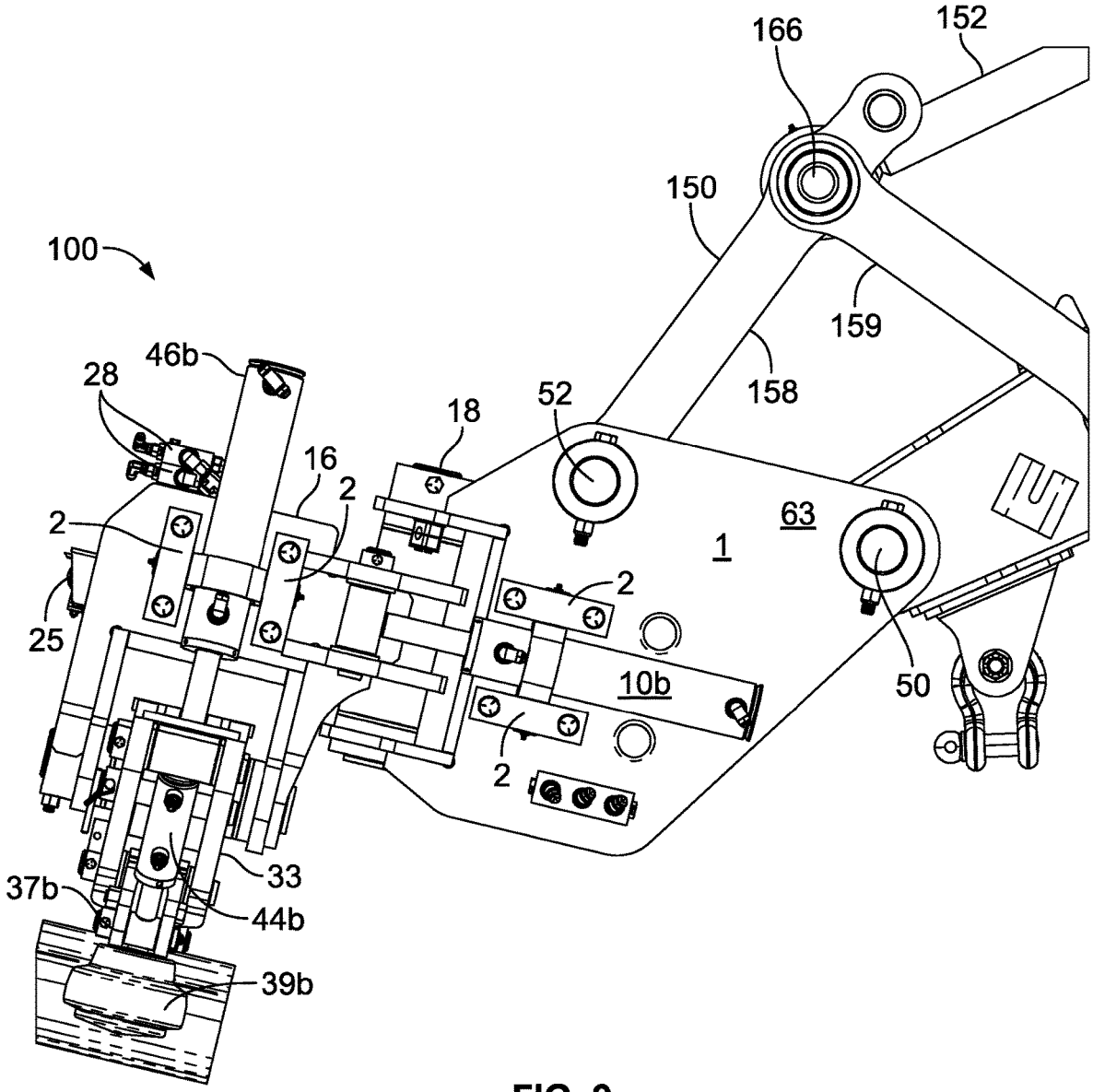
FIG. 9 is a right side elevation view of the embodiment of FIG. 1 shown positioned on an end of a boom and in a second pitch position.
Figure 10:
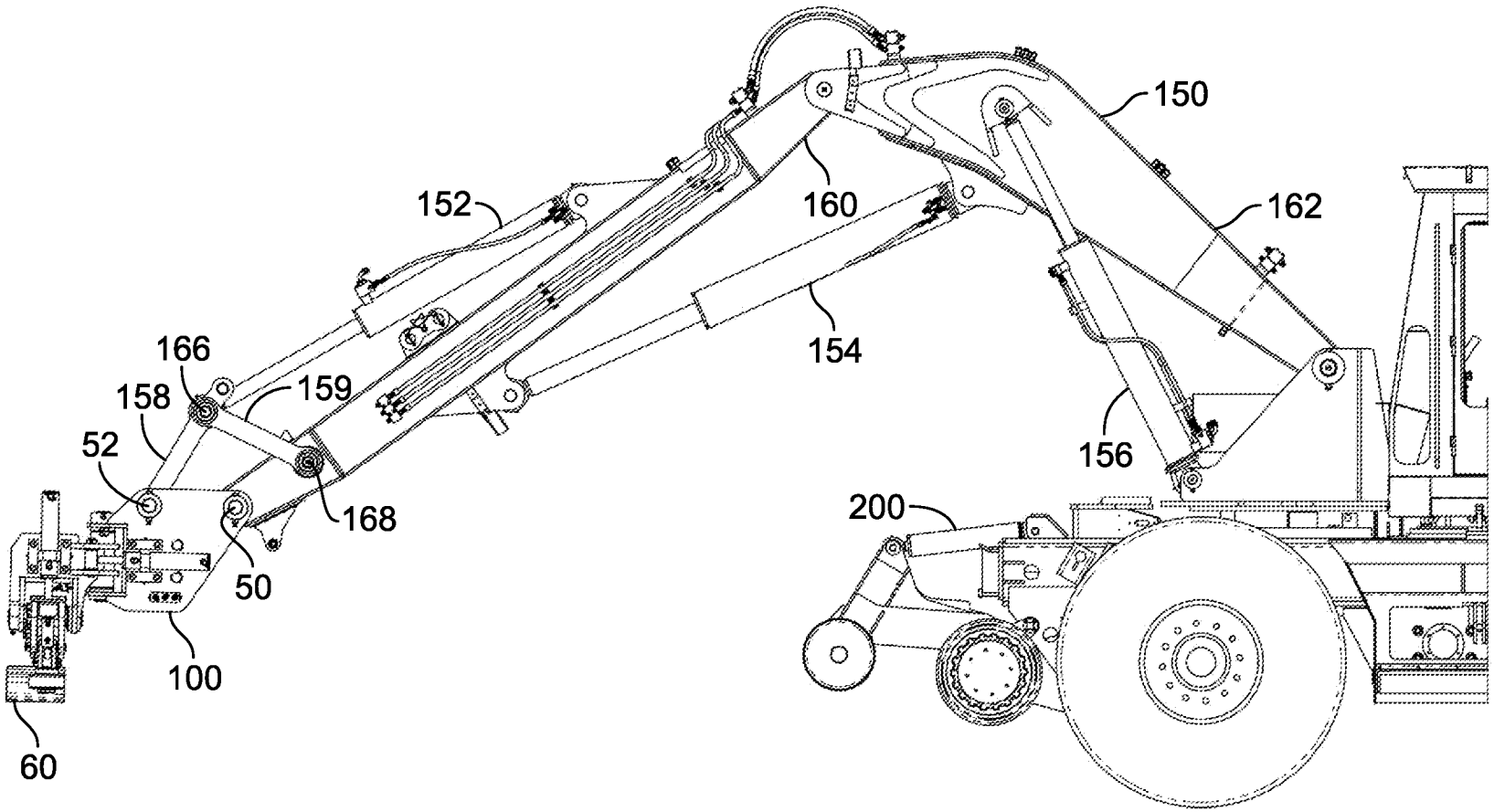
FIG. 10 is right side elevation view of the embodiment of FIG. 1 shown positioned on an end of a boom and in a first pitch position.
Figure 11:
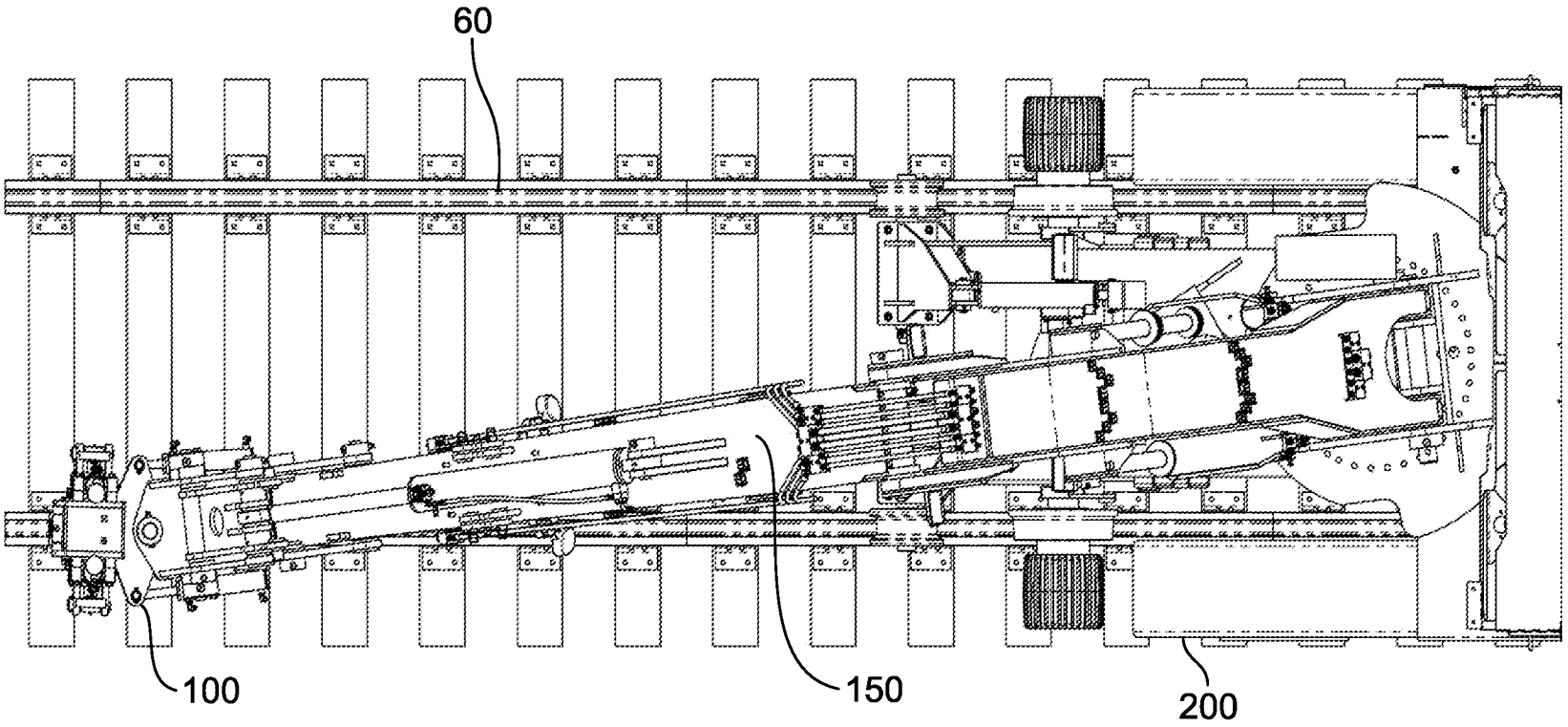
FIG. 11 is a top plan view of the embodiment of FIG. 1 shown positioned on an end of a boom with the manipulator box shown in a second yaw position.
Figure 12:
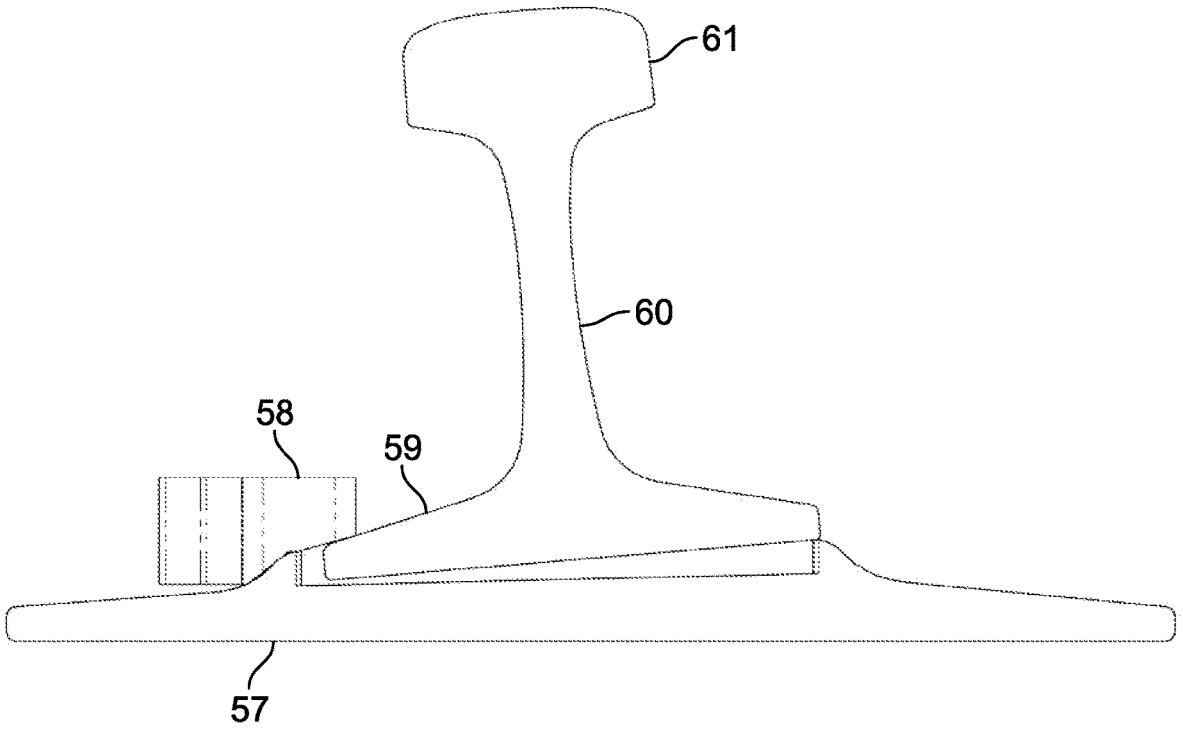
FIG. 12 is a front elevation view of a cross section of a rail before and after insertion of a rail on top of a tie plate under a lug, where the lug is shown on an inside side of the rail.
Figure 12:
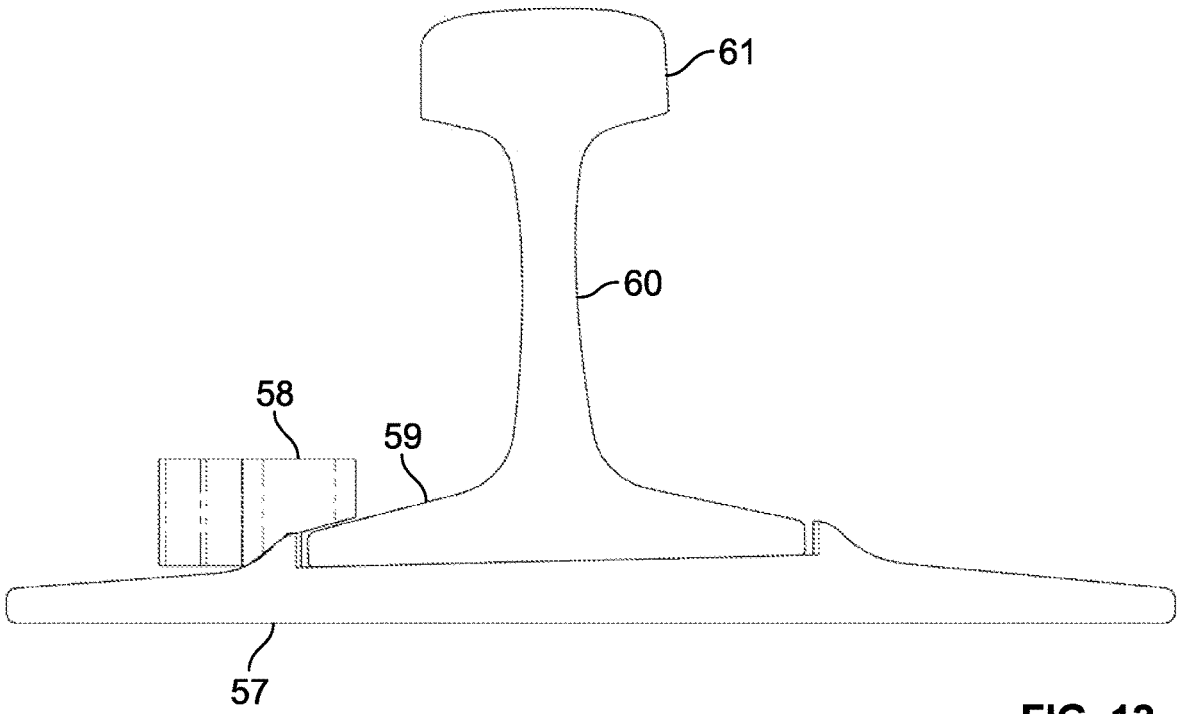
Figure 13:
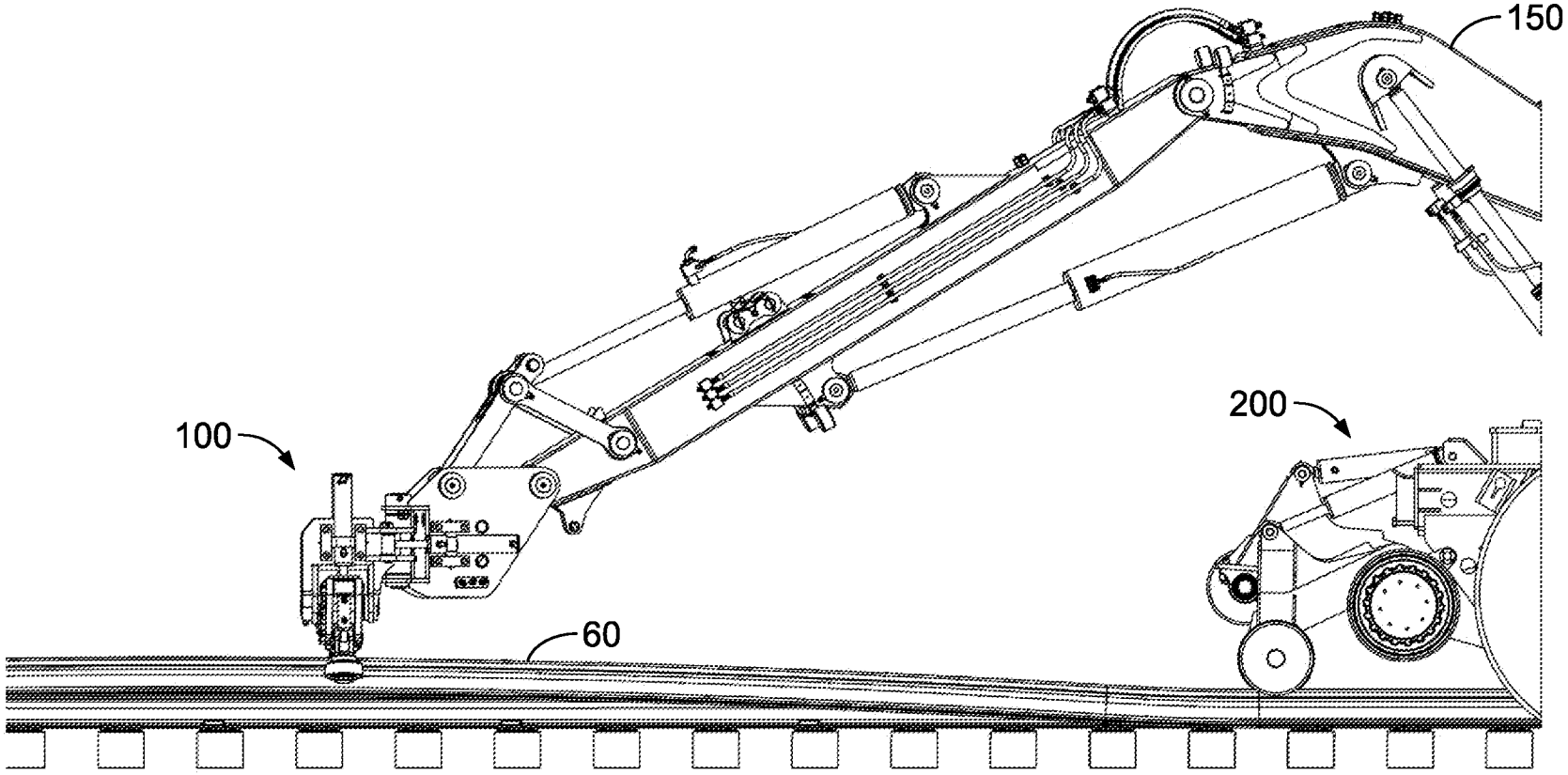
FIG. 13 is a right side elevation view of a the embodiment of FIG. 1 shown positioned on an end of a boom and shown engaged with a rail in a canted position.

Meanwhile, as best shown in FIG. 10, boom 150 of rail machine 200 includes hydraulic cylinders 152, 154, 156. While cylinders 154 and 156 are configured to articulate respective boom arms 160 and 162, as shown in FIGS. 8-9, cylinder 152 is configured to articulate boom arms 158, 159 forwardly and rearwardly via pin joints 166, 168 and pin 52, which in turn pivots manipulator head 1 upwardly and downwardly about pin 50 in the pitch direction. Angle sensor 11 may be mounted to manipulator head 1 to measure the pitch angle induced by cylinder 152 to inform the processor and ultimately the operator via a display or user interface described above.

In the embodiment shown in the figures, manipulator head 1 includes opposed, parallel side walls 62, 63, front wall 64, rear wall 65, and bottom wall 66 positioned opposite and parallel to top wall 67—all arranged to form a box-like structure. Top wall 67 and bottom wall 66 are parallel to one another. Rear wall 65 is angled to follow the slanted profile of side walls 62, 63. Manipulator head 1 also includes a plurality of receivers 68 for receiving pins 6, 50, and 52. Respective receivers 68 may be welded to side walls 62, 63, top wall 67 and bottom wall 66.

Respective yaw cylinders 10*a*, 10*b* are mounted to respective side walls 62, 63 via trunnion mounts 2 positioned above and below yaw cylinders 10*a*, 10*b*. Trunnion mounts 2 each include receivers 3 to receive a respective cylinder mount post 9 to enable each yaw cylinder to pivot thereon.

In the embodiment shown in the figures, manipulator box 16 includes opposed, parallel side walls 72, 73, front wall 74 positioned opposite and parallel to rear wall 75, and bottom wall 76 positioned opposite and parallel to top wall 77—all arranged to form a box-like structure. Front wall 74 and rear wall 75 extend below bottom wall 76. Manipulator box 16 also includes rearwardly extending parallel top wall 82 and bottom wall 83 for engaging manipulator head 1. Manipulator box 16 also includes a plurality of receivers 78 for receiving pin 18, sleeve 79 for receiving pin 6, and a plurality of receivers 80 for receiving pins 19. Respective receivers 78 may be welded to front wall 74 and rear wall 75, and respective receivers 80 on top wall 82 may be welded to top wall 82.

Respective cant or roll cylinders 46*a*, 46*b* are mounted to respective side walls 72, 73 via trunnion mounts 2 positioned forwardly and rearwardly of cant or roll cylinders 46*a*, 46*b*. As discussed above, trunnion mounts 2 each include receiver 3 to receive a respective cylinder mount post 9 to enable each cant or roll cylinder 46*a*, 46*b* to pivot thereon. Camera 25 may be secured to a pedestal positioned on front wall 74. Camera cover 31 may be secured to the pedestal to cover and protect camera 25.

In the embodiment shown in the figures, manipulator head 33 includes front wall 92 positioned opposite and parallel to rear wall 93, top wall 94 positioned opposite and parallel to bottom wall 95 (not shown), and opposed, parallel side walls 98 (not shown)—all arranged to form a box-like structure. Manipulator head 33 also includes sleeve 96 for receiving pin 18.

Manipulator head 33 also includes rail squeeze cylinders 44*a*, 44*b* connected to respective rail manipulator arms 37*a*, 37*b*, which are connected to and pivot on respective pins 34*e*, 34*f*. Rail manipulator arms 37*a*, 37*b* are configured to receive respective roller assemblies 39*a*, 39*b* and are configured as a clevis to receive rail squeeze cylinders 44*a*, 44*b*. An upper end 86*a*, 86*b* of rail squeeze cylinders 44*a*, 44*b* is connected to respective pins 34*a*, 34*d* while a lower end 87*a*, 87*b* of rail squeeze cylinders 44*a*, 44*b* is connected to respective pins 43*a*, 43*b*. Pins 34*a*, 34*d* are configured to pass through receivers 55*a*, 55*d*, and pins 43*a*, 43*b* are configured to pass through and be received by receivers 56*a*, 56*b*.

Turning now to FIG. 15, there is shown an embodiment of a cab 205 of the rail machine 200. Cab 205 is configured as an enclosure for an operator. However, in other embodiments, cab 205 may be configured any number of known ways. In this embodiment, although only one operator is needed to operate rail threader workhead 100, a pair of operator stations 210 are positioned side by side on opposite ends of the front of cab 205 to allow flexibility of an operator to switch seats to install either an inside rail or an outside rail across a set of railroad ties. Each of the operator stations 210 are strategically positioned to provide an operator with an unobstructed view of the respective inside rail or outside rail.

To operate rail threader workhead, an operator would (i) position boom 150 over a desired rail 60 to be moved (see FIG. 3), (ii) command rail squeeze cylinders 44*a*, 44*b* to extend to cause roller assemblies 39*a*, 39*b* to engage with the head 61 of the selected rail 60 (see FIG. 4), (iii) command cylinder 152 to retract or extend to cause manipulator head 1 to pitch up or down as needed (see FIGS. 8-9), (iv) command yaw cylinders 10*a*, 10*b* to retract or extend to cause manipulator head 16 to yaw to the right or to the left as desired (see FIGS. 6-7, 11, and 14), (v) command cant or roll cylinders 46*a*, 46*b* to retract or extend to cause manipulator head 33 to cant or roll in a desired direction as needed (see FIGS. 4-5) to enable insertion of a flange 59 of rail 60 under rail lug 58 positioned on an inside location of tie plate 57 (see FIGS. 12-16). These commands may be performed manually or automatically in a sequence, or multiples of these commands may be performed manually or automatically simultaneously.

The embodiments described herein are possible examples of implementations and are merely set forth for a clear understanding of the principles of the features described herein. Many variations and modifications may be made to the above-described embodiment(s) without substantially departing from the spirit and principles of the techniques, processes, devices, and systems described herein. All such modifications are intended to be included herein within the scope of this disclosure and protected by the following claims.

What is claimed is:

1. A rail threader workhead for attachment to an end of a rail machine boom and configured for placing a railroad rail upon a section of railroad ties, comprising:

a first manipulator head configured to mount to the end of the rail machine boom and pivot in a vertical pitch direction;

a manipulator box extending from the first manipulator head and configured to pivot in a horizontal yaw direction; and a second manipulator head extending from the manipulator box, wherein the second manipulator head comprises a pair of roller assemblies configured to engage the railroad rail, wherein the second manipulator head is configured to pivot in a cant or roll direction.

2. The rail threader workhead of claim 1, wherein the first manipulator head, the manipulator box, and the second manipulator head are configured to operate independently of one another.

3. The rail threader workhead of claim 1, wherein the first manipulator head, the manipulator box, and the second manipulator head are configured to operate simultaneously with one another.

4. The rail threader workhead of claim 1, wherein the first manipulator head, the manipulator box, and the second manipulator head are configured to operate in series with one another.

5. The rail threader workhead of claim 1, wherein the first manipulator head includes a pair of first hydraulic cylinders configured to pivot the manipulator box in the horizontal yaw direction.

6. The rail threader workhead of claim 5, wherein each of the pair of first hydraulic cylinders is configured to pivot about a vertical axis that intersects a longitudinal axis of each of the pair of first hydraulic cylinders.

7. The rail threader workhead of claim 1, wherein the manipulator box includes a pair of second hydraulic cylinders configured to pivot the second manipulator head in the cant or roll direction.

8. The rail threader workhead of claim 7, wherein each of the pair of second hydraulic cylinders is configured to pivot about a horizontal axis that intersects a longitudinal axis of each of the pair of second hydraulic cylinders.

9. The rail threader workhead of claim 1, wherein the second manipulator head includes a pair of third hydraulic cylinders configured to actuate the pair of roller assemblies to engage the railroad rail.

10. The rail threader workhead of claim 9, wherein the second manipulator head includes a pair of first pins, a pair of second pins, and a pair of roller arms, wherein each of the pair of roller arms pivotably connected to a respective one of the pair of first pins, wherein each of the third hydraulic cylinders includes an upper end that is pivotably connected to a respective one of the pair of second pins, and wherein each of the third hydraulic cylinders includes a lower end that is connected to a respective one of the pair of roller arms.

11. The rail threader workhead of claim 10, wherein each of the roller assemblies is connected to a respective one of the roller arms.

12. The rail threader workhead of claim 10, wherein each of the roller assemblies includes a pair of roller bearings configured to rotate on an internal shaft that is mounted to a respective one of the roller arms.

13. The rail threader workhead of claim 1, including a first horizontal pin, a vertical pin, and a second horizontal pin, wherein the second horizontal pin is perpendicular to the first horizontal pin, and wherein the first manipulator head is configured to pivot about the first horizontal pin that is perpendicular to a longitudinal axis of the rail machine boom, the manipulator box is configured to pivot about the vertical pin, and the second manipulator head is configured to pivot about the second horizontal pin.

14. A rail threader workhead for attachment to an end of a rail machine boom and configured for placing a railroad rail upon a section of railroad ties, comprising:

a first horizontal pin;

a first manipulator head configured to mount to the end of the rail machine boom, wherein the first manipulator head is configured to pivot in a vertical pitch direction about the first horizontal pin that is perpendicular to a longitudinal axis of the rail machine boom;

a vertical pin;

a manipulator box extending from the first manipulator head and configured to pivot about the vertical pin in a horizontal yaw direction;

a second horizontal pin that is perpendicular to the first horizontal pin; and a second manipulator head extending from the manipulator box and configured to pivot in a cant or roll direction about the second horizontal pin.

15. The rail threader workhead of claim 14, wherein the first manipulator head includes a first panel, a first receiver connected to the first panel, a second panel, and a second receiver extending from the second panel, and wherein the first horizontal pin is attached to and extends from the first receiver to the second receiver.

16. The rail threader workhead of claim 14, wherein the first manipulator head includes a top panel, a top receiver connected to the top panel, a bottom panel, and a bottom receiver connected to the bottom panel, and wherein the vertical pin is attached to and extends from the top receiver to the bottom receiver.

17. The rail threader workhead of claim 14, wherein the manipulator box includes a front panel, a front receiver connected to the front panel, a rear panel, and a rear receiver connected to the rear panel, and wherein the second horizontal pin is attached to and extends from the front receiver to the rear receiver.

18. The rail threader workhead of claim 14, including a pair of roller assemblies attached to the second manipulator head and configured to engage the railroad rail, wherein the pair of roller assemblies is configured to permit movement of the railroad rail in the cant or roll direction when the second manipulator head pivots in the cant or roll direction.

19. The rail threader workhead of claim 14, wherein the first manipulator head includes a pair of first hydraulic cylinders configured to pivot the manipulator box in the horizontal yaw direction;

the manipulator box includes a pair of second hydraulic cylinders configured to pivot the second manipulator head in the cant or roll direction; and the second manipulator head includes a pair of third hydraulic cylinders configured to actuate a pair of roller assemblies to engage the railroad rail in a manner that permits movement of the railroad rail in the cant or roll direction when the second manipulator head pivots in the cant or roll direction.

20. The rail threader workhead of claim 19, including a pair of roller arms that are pivotably attached to a pair of first pins of the second manipulator head, wherein each of the pair of third hydraulic cylinders includes an upper end pivotably connected to a respective one of a pair of second pins and a lower end connected to a respective one of the pair of roller arms.

* * * * *